US005274299A

United States Patent [19]

Vegter

[11] Patent Number: 5,274,299

[45] Date of Patent: Dec. 28, 1993

[54] GRID CONTROLLED GAS DISCHARGE LAMP

[75] Inventor: Klaas Vegter, Eindhoven, Netherlands

[73] Assignee: North American Philips Corporation, New York, N.Y.

[21] Appl. No.: 895,572

[22] Filed: Jun. 8, 1992

Related U.S. Application Data

[63] Continuation of Ser. No. 634,370, Dec. 27, 1990, abandoned.

[51] Int. Cl.[5] ..... H01J 1/46; H01J 1/62

[52] U.S. Cl. ..... 313/293; 313/492; 313/597

[58] Field of Search ..... 313/492, 597, 293, 616, 313/308, 294

[56] References Cited

U.S. PATENT DOCUMENTS

| | | | |
|---|---|---|---|
| 2,117,246 | 5/1938 | Hagland | 313/597 X |
| 2,725,497 | 11/1955 | Mason | 313/492 X |
| 2,899,586 | 10/1959 | Hernqvist | 313/167 |
| 3,376,457 | 4/1968 | Hoeh | 313/492 |
| 4,521,718 | 6/1985 | Byszewski et al. . | |
| 4,620,135 | 10/1986 | Donaldson | 315/326 |

FOREIGN PATENT DOCUMENTS

| | | | |
|---|---|---|---|
| 685386 | 4/1964 | Canada | 313/597 |
| 8505489 | 12/1985 | PCT Int'l Appl. . | |
| 554573 | 10/1977 | U.S.S.R. | 313/492 |
| 854597 | 11/1960 | United Kingdom . | |

*Primary Examiner*—Sandra L. O'Shea
*Attorney, Agent, or Firm*—William L. Botjer

[57] ABSTRACT

A low pressure gas discharge lamp (such as a fluorescent lamp) which includes a wire mesh grid disposed within the lamp envelope so as to intercept the electrons flowing between the lamp electrodes. A lead wire extends from the grid to the outside of the lamp envelope, when the grid is provided with a negative voltage with respect to the surrounding plasma the lamp may switched off. The grid controlled lamp eliminates the need for a solid state power switch in the lamp driving circuitry. As such, the lamp current flows only through the lamp not through the electronic ballast/lamp driving circuitry. With the lamp current removed from the ballast circuitry, power dissipation problems in the driver circuitry is eliminated. The grid controlled lamp design greatly facilitates circuit design.

13 Claims, 6 Drawing Sheets

GRIDLAMPS IN HALF-BRIDGE CONFIGURATION

GRID CONTROLLED GAS DISCHARGE LAMP

This is a continuation of application Ser. No. 07/634,370, filed Dec. 27, 1990, now abandoned.

BACKGROUND OF THE INVENTION

This invention relates to low pressure gas discharge lamps such as fluorescent lamps and the circuitry for driving low pressure gas discharge lamps. Specifically, this invention relates to a fluorescent lamp which is capable of operating as an active circuit component in its own driving circuitry.

This application is related to copending application Ser. No. 744,190 entitled "GAS DISCHARGE LAMP WITH GRID AND CONTROL CIRCUITS THEREFOR" filed Aug. 12, 1991 and assigned to the same assignee as this application.

Fluorescent lamps are in wide use because of their relatively high efficiency, low cost and long life. A fluorescent lamp is a low pressure mercury gas discharge lamp. As with all gas discharge lamps, fluorescent lamps have a negative resistance characteristic and require ballast circuitry to prevent current runaway. For many years the conventional ballast has been a copper/iron choke. However, in recent years, electronic ballasts for gas discharge lamps have become increasingly popular in the lighting industry. Apart from being more efficient than the conventional choke, the electronic ballast is lighter and offers the possibility of adding additional control features to the lamp such as dimming and lamp power stabilization. A disadvantage of electronic ballasts is their high price due in part to their requirement for the use of relatively expensive solid state power switches in the control circuitry. A solid state power switch is relatively expensive and must carry large amounts of current. As such, the heat generated by a solid state power switch is not inconsequential and must be factored into the design of the ballast circuitry.

In current industry practice fluorescent lamps and their driving/ballast circuitry are usually designed by different groups of engineers. New lamp designs are designed by one team of engineers, without concern for driving circuitry, and "thrown over the wall" to the ballast designers. Conversely, new ballast designs may be designed without concern for the lamps they will drive. This can lead to lamps and driving circuitry which are at best, not optimized to work together or at worst, incompatible. The present invention provides a lamp design in which the lamp itself functions as part of its own driver circuitry. The lamp itself operates as its own active high current component eliminating the need for high current devices in the electronic ballast/-driving circuitry.

SUMMARY OF THE INVENTION

The present invention is directed to a low pressure gas discharge lamp (such as a fluorescent lamp) which includes a wire mesh grid disposed within the lamp envelope so as to intercept the plasma between the lamp electrodes. A lead wire extends from the grid to the outside of the lamp envelope. When the grid is provided with a negative voltage with respect to the surrounding plasma the lamp may be switched off. The grid controlled lamp eliminates the need for a solid state power switch in the ballast circuitry. As such, the lamp current flows only through the lamp, not through the electronic ballast/lamp driving circuitry. With the lamp current removed from the ballast circuitry, power dissipation problems in the driver circuitry are eliminated. Only low current switches in the driving circuitry are required as the lamp current flows only through the lamp and not to the grid. The grid controlled lamp design greatly facilitates circuit design and integrates the lamp and its switching function.

BRIEF DESCRIPTION OF THE DRAWINGS

For a better understanding of the invention reference is made to the following drawings which are to be taken in conjunction with the detailed specification to follow.

DESCRIPTION OF THE PREFERRED EMBODIMENTS

Figure 1:
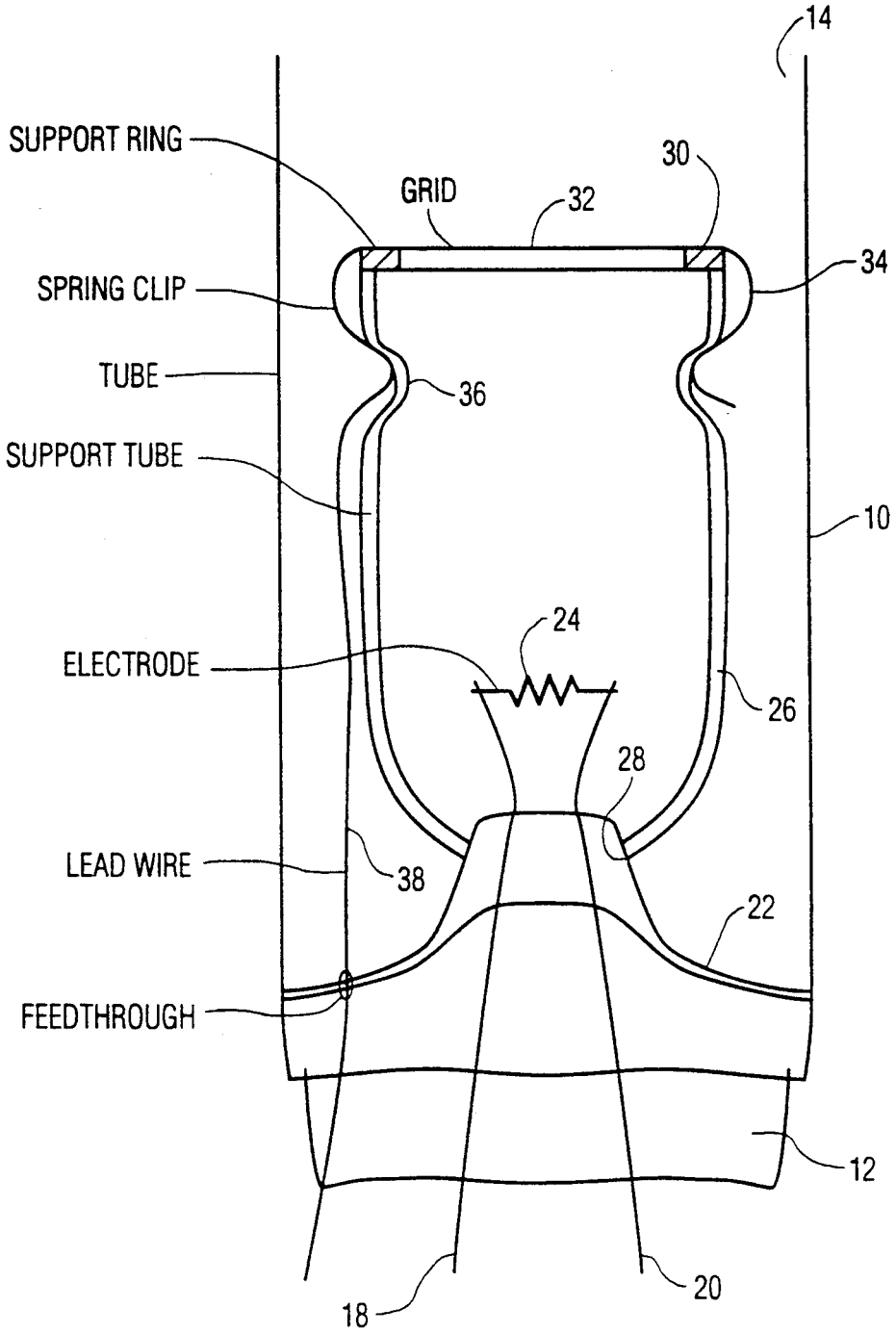
FIG. 1 is a sectional view of a first embodiment of a grid controlled gas discharge lamp.

FIG. 1 illustrates a first embodiment of a grid controlled gas discharge lamp constructed in accordance with the invention. The lamp includes the usual glass envelope 10 and a metallic end cap 12 which includes the usual connectors (not shown) for connection to the source of lamp current. The inner surface of envelope 10 is coated with phosphors which fluoresce in the presence of a plasma. Conductive feed-throughs 18, 20 extend through a glass stem 22 and are connected to a cathode or electrode 24. This structure is a conventional fluorescent lamp. It should also be noted that the invention is also applicable to other low pressure discharge lamps such as a low pressure sodium vapor lamp.

A cylindrical support tube 26 has an opening 28 at its lower portion which is sealed to stem 22. The upper portion of support tube 26 mounts a support ring 30 which is used to support a conductive grid 32 so as to enclose the upper opening of support tube 26. A spring clip 34 surrounds the upper portion of support tube 26 and assures that grid 32 and support ring 30 are held in close contact with support tube 26. Spring clip 34 is held in place by a circumferential indentation 36 disposed in tube 26. A lead wire 38 provides electrical connection through lamp stem 22 to grid 32. In this manner, the control voltages may be applied to grid 32.

As is discussed below, grid 32 is a square mesh tungsten grid of about 70% open area, with the fineness of the mesh being controlled by the desired circuit and operational parameters. The overall design of the support tube 26 is not critical. The only important characteristic is that the electrons flowing from electrode 24 must pass through grid 32. If there was a path around grid 32, the lamp would not function as grid 32 would be unable to interrupt the electron flow.

Figure 2:
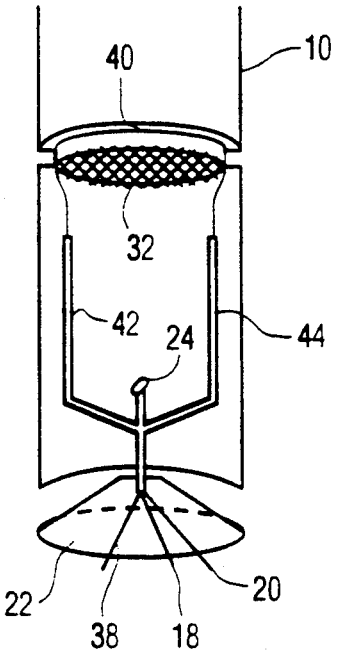
FIG. 2 is another embodiment of a grid controlled discharge lamp.

FIG. 2 shows a second embodiment of the grid controlled fluorescent lamp. In this drawing the same reference numerals are utilized to indicate like structure as in FIG. 1. Lamp envelope 10 includes an inwardly disposed indentation 40 which serves as the upper limit and seal for grid 32. The lower support for grid 32 is formed by the lead wires 38. Lead wires 38, connected to grid 32, run within hollow glass tubes 42, 44 for electrical isolation from the plasma.

Figure 3A:
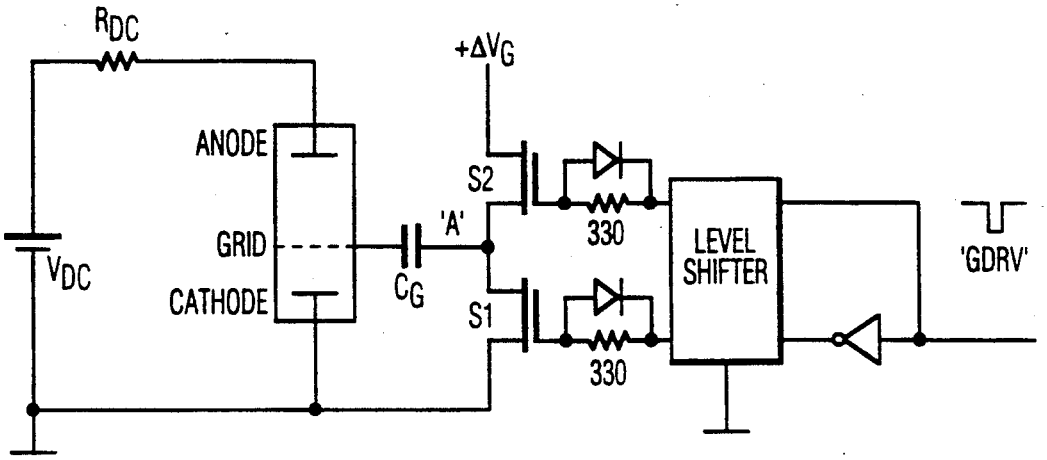
FIG. 3*a* is a schematic diagram of the circuitry which may be utilized to test the operational parameters of grid controlled gaseous discharge lamps.
Figure 3B:
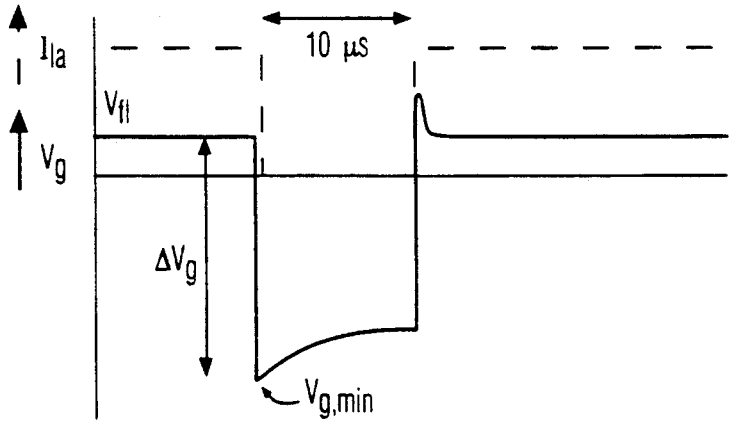
FIGS. 3*b* and 3*c* illustrate the lamp voltage and current in response to the driving pulses.
Figure 3C:
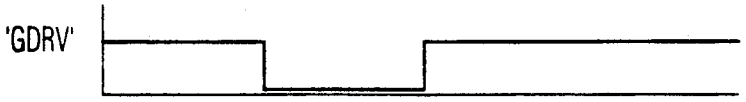

In operation a grid disposed in an ionized gas plasma by virtue of its bombardment with charged ions and electrons will be placed at a positive voltage relative to the cathode which is at 0 volts. In this application this voltage on the grid is referred to as the floating voltage ($V_{fl}$). In order to interrupt the current the floating voltage must be overcome before driving the grid further negative. FIG. 3*a* shows the circuit that was used for low frequency measurements of the grid controlled lamp. FIGS. 3*b* and 3*c* show the voltages and current flowing in the grid controlled lamp in response to the grid driving pulses (GDRV). The lamp is operated from a voltage source, $V_{DC}$, ballasted with a resistor, $R_{DC}$. Because of the constant lamp current, the plasma is in a well defined state. DC operation is convenient but not necessary. S1 and S2 are high voltage, low power solid state switches (MOSFET), driven by a solid state level shifter. 'GDRV' is the control signal supplied by any suitable pulse generating circuitry. When the drive signal (GDRV) is high, S2 conducts and S1 is off. In this state, the lamp is on ($I_{la}>0$). As a result, the grid is at the floating potential, $V_{FL}$, and A is at $+\Delta V_g$. The voltage across the grid capacitor, $C_g$, is ($\Delta V_g - V_{fl}$). To prevent shoot-through, turn-on of S1 and S2 is softened a bit by putting a 330 Ω resistor in series with the gates.

When 'GDRV' goes low, S1 turns on and S2 turns off, node "A" is connected to ground and since the voltage across $C_g$ is still ($\Delta V_g - V_{fl}$), the grid is pulled down to $-(\Delta V_g - V_{fl})$. If this is negative enough, the lamp current is interrupted ($I_{LA}=0$). During the negative pulse, the grid current $I_g$ discharges $C_g$. Therefore, $C_g$ must be large enough to maintain a sufficiently negative voltage on the grid. When 'GDRV' goes high again, A is connected to $+\Delta V_g$ and the grid has a voltage somewhat above $V_{fl}$. As a result, the grid functions as an anode, collecting electrons, until it is back at $V_{fl}$. Because this current is an electron current, it is much bigger than the grid current, $I_g$, which is a diffusion limited ion current.

Figure 4:
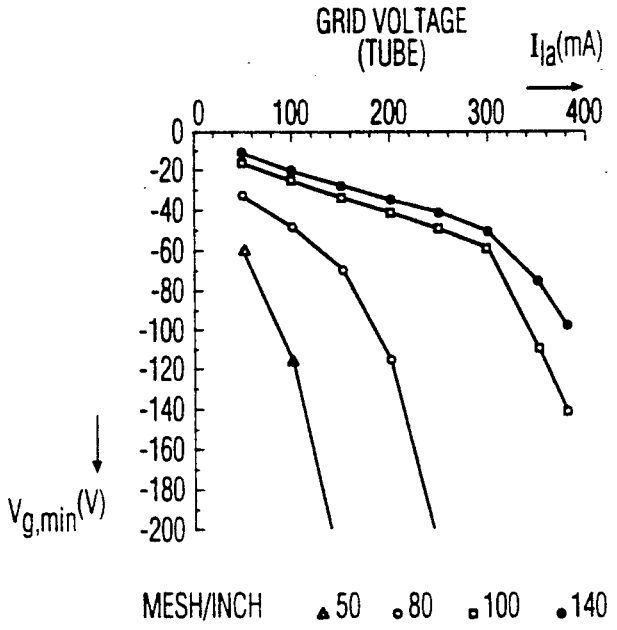
FIG. 4 is a chart of the minimum grid voltage required to interrupt the discharge lamp current of the lamp of FIG. 1 versus lamp currents; at differing mesh sizes
Figure 5:
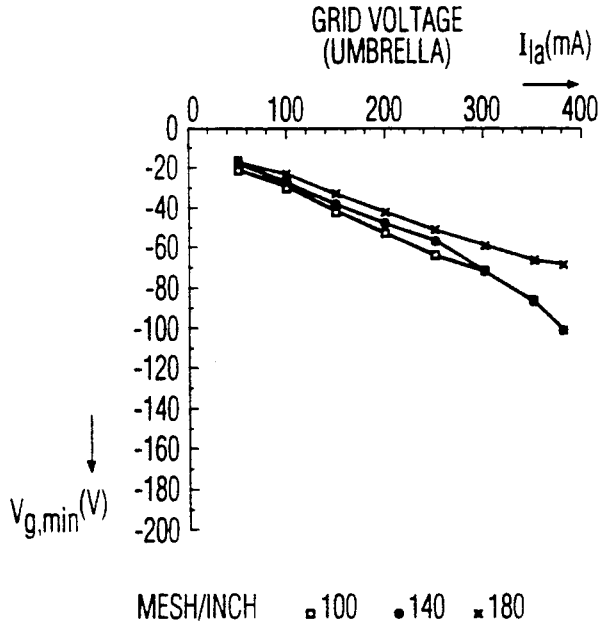
FIG. 5 is a chart of minimum grid voltage required to interrupt the current of the gaseous discharge lamp of FIG. 2 versus lamp current for a variety of mesh sizes.
Figure 6:
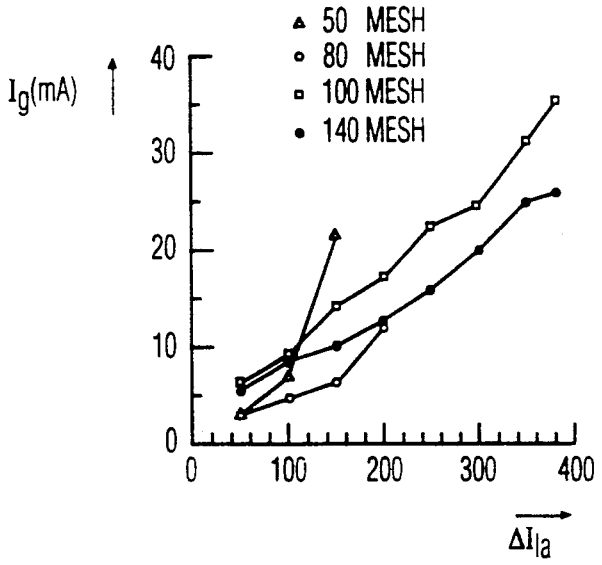
FIG. 6 is a chart of rid current as a function of lamp current for various mesh sizes.

FIG. 4 shows $V_{g,min}$ as a function of $I_{la}$ for lamps with 50, 80, 100 and 140 mesh per inch tungsten grids in the configuration shown in FIG. 1. FIG. 5 is a similar graph for lamps constructed as shown in FIG. 2 with 100, 140 and 180 mesh/inch tungsten grids. The polarity of the lamp was chosen such that the grid is close to the cathode. The curves represent the averages of 2 to 5 lamps. As expected, $V_{g,min}$ is more negative at higher $I_{la}$. Also, the finer the grid, the easier the switching. The differences between the 100, 140 and 180 mesh/inch grids are relatively small. There are also small differences between the 100 and 140 lamps of the two different configurations. The mesh used in the grids should be regular (i.e. all the wires in the mesh are uniformly spaced apart), if this is not the case the switching capability of the grid can be greatly deteriorated ($V_g$ becomes too large). FIG. 6 shows grid current ($I_g$) in milliamps as a function of lamp current ($I_{LA}$) for various mesh sizes. It is seen that the grid current is much lower than that of the current flowing through the lamp which permits the use of low current switches in the grid control circuitry.

If the grid is close to the anode instead of the cathode, $V_{g,min}$, stays approximately the same. $\Delta V_g$ (the difference between $V_{fl}$ and $V_{g,min}$), however, is much higher as $V_{fl}$ is higher. This is not trivial, because the thickness of the space charge layer is a function of the voltage drop across it ($V_{fl}-V_g$). However, when the current is interrupted, the potential of the plasma around the grid changes. Thus the grid must be made negative with respect to the cathode to obtain switching. $V_{g,min}$ does not change very much with the position of the grid in the lamp. With the grid closer to the cathode $\Delta V_g$ can be kept smaller and this is desirable. However, the grid must not be too close to the cathode since the plasma is different in close proximity and switching becomes very different. Distances of ¼" to ½" from grid to cathode give satisfactory results. Grids 32 were constructed from square mesh tungsten round wire usually used for chemical sieving. The grids have about 70% open area and tungsten is relatively sputtering resistant. However other materials may also be used (such as nickel or molybendum).

Figure 7:
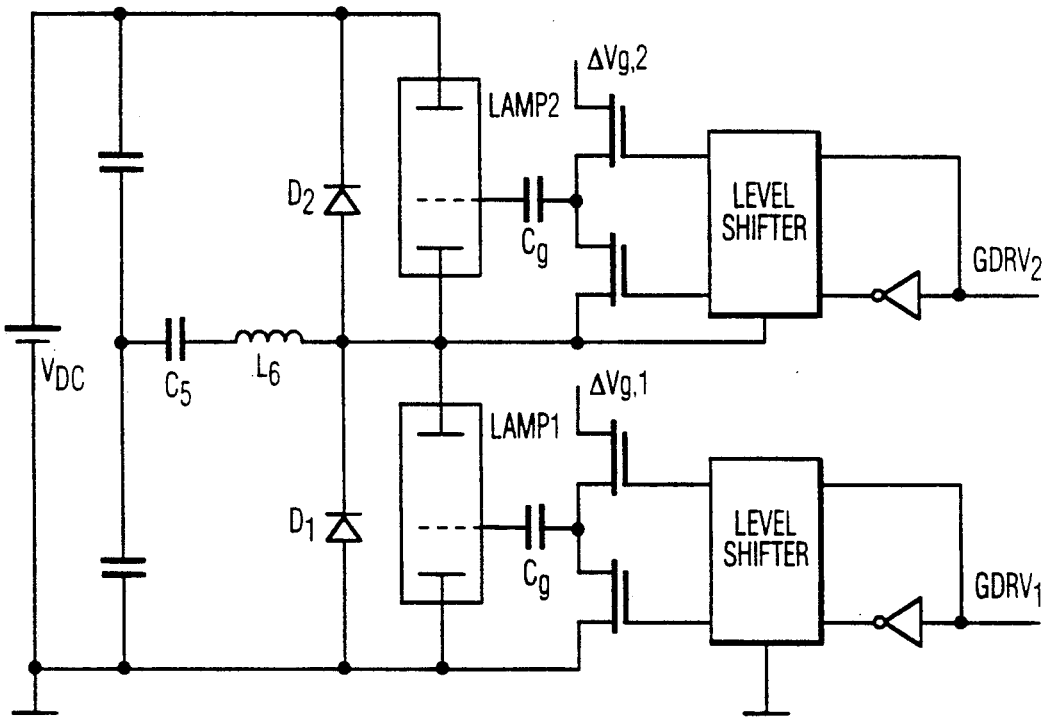
FIG. 7 is a circuit diagram utilizing a pair of grid lamps mounted in a "half-bridge" like configuration with the grid lamps operating as the control components in their own driver circuitry.

FIG. 7 illustrates a practical grid lamp circuit. As can be seen the grids are driven, by signals $GDRV_1$ and $GDRV_2$ in a manner similar to that of FIG. 3. The two grid lamps are connected in a "half-bridge" like configuration with the grid lamps forming one-side of the bridge and the other side of the bridge being formed by capacitors $C_1$ and $C_2$. As lamps 1 and 2 need not be switched on and off simultaneously, diodes $D_1$ and $D_2$ which are connected in parallel therewith provide alternate paths for current flow when one or both of the lamps are turned off. Bridging the lamps are resonant elements $C_S$ and $L_S$ which form a tuned circuit. As is seen, each of the lamps replaces a solid state power device. The grid driver elements ($S_1$, $S_2$, $S_3$, $S_4$) consist only of high-voltage, low-power devices.

The circuit of FIG. 7, depending upon the operating frequency and the values of resonant elements $C_S$ and $L_S$ may be operated in either the so-called capacitive or inductive modes. In these modes lamps 1 and 2 may be turned off either by the action of the grids or by the action of the resonant circuitry. Operation in either of these modes may at various frequencies prevent deleterious so-called "constriction". Constriction occurs when the electrons of the plasma try to force their way through one of the openings of the grid. When this occurs the wires of the grid at the point where constriction occurs can burn out, which causes failure of the controlling grid. Such constriction may be avoided by controlling the parameters of the circuit elements of the circuit of FIG. 7 and by controlling the speed of changes in lamp current and grid voltage. Other possible circuit elements, such as described in the copending application referred to at page 1 may also be used in conjunction with the grid controlled lamp of the present invention.

In the schematic of FIG. 7 the lamps are shown being driven with $V_{DC}$. However, as is known to those skilled in the art, $V_{DC}$ may be any DC source such as rectified power line voltage. The circuit may be operated at frequencies of at least 20 KHz which is a standard operating frequency for solid state lamp driver circuits.

Accordingly, FIG. 7 illustrates that the grid controlled gas discharge lamps constructed in accordance with the present invention form an integral part of their own driving circuity without the need for high current switching devices. This provides meaningful cost and heat dissipation savings.

Although the present invention has been described in conjunction with preferred embodiments, it is to be understood that modifications and variations may be resorted to without departing from the spirit and scope of the invention, as those skilled in the art will readily understand. Such modification and variations are considered to be within the purview and scope of the invention and the appended claims.

I claim:

1. A gas discharge lamp comprising:

a light transmissive envelope including an inwardly extending ridge, a fluorescent coating disposed within the inner surface of said envelope, first and second electrodes disposed within said envelope, an ionizable gas filling said envelope, said gas becoming a charged plasma when a current flows between said first and second electrodes and causing fluorescence of said fluorescent coating;

a conductive grid of at least 50 mesh/inch disposed within said envelope and in contact with said ridge, said grid being positioned so as to intercept substantially all of the current flowing between said first and second electrodes; and means for electrical connection to said grid.

2. The gas discharge lamp as claimed in claim 1 wherein said grid comprises a tungsten mesh of 50 to 180 mesh/inch.

3. The gas discharge lamp as claimed in claim 1 wherein said first and second electrodes comprise an anode and a cathode, said grid being disposed closer to said cathode than said anode.

4. A gas discharge lamp as claimed in claim 1 wherein said ridge in said envelope comprises an indentation in said envelope.

5. A gas discharge lamp as claimed in claim 1 further including an end cap having means for electrical connection to at least one of said electrodes and means for electrical connection to said grid.

6. The gas discharge lamp as claimed in claim 1 wherein said ionizable gas comprises mercury vapor.

7. A low pressure gas discharge lamp for generating visible light in an illumination system and having a light transmissive envelope, first and second electrodes disposed within said envelope, sodium vapor filling said envelope, conductive grid means of more than 50 mesh/inch disposed within said envelope so as to intercept substantially all of the electrons flowing between said electrodes and means for electrical connection to said grid and means for generating light of primarily the visible spectrum.

8. The lamp as claimed in claim 7 wherein said grid is formed of tungsten wire.

9. A gas discharge lamp comprising;

a light transmissive envelope, a fluorescent coating disposed within the inner surface of said envelope, an anode and a cathode disposed within said envelope, an ionizable gas filling said envelope, said gas becoming a charged plasma when a current flows between said first and second electrodes and causing fluorescence of said fluorescent coating;

a conductive grid disposed within said envelope said grid being disposed closer to said cathode than said anode, said grid being positioned so as to intercept substantially all of the current flowing between said first and second electrodes; and means for electrical connection to said rid.

10. The gas discharge lamp as claimed in claim 9 wherein said grid comprises a mesh of 50 to 180 mesh/inch.

11. A gas discharge lamp as claimed in claim 9 wherein said envelope includes an inwardly disposed indentation, said grid being disposed in contact with said indentation.

12. A gas discharge lamp as claimed in claim 9 further including an end cap having means for electrical connection to at least one of said electrodes and means for electrical connection to said grid.

13. The gas discharge lamp as claimed in claim 9 wherein said ionizable gas comprises mercury vapor.

* * * * *